US011153955B1

(12) United States Patent
Ross

(10) Patent No.: US 11,153,955 B1
(45) Date of Patent: Oct. 19, 2021

(54) ELECTRONIC CANDLE SYSTEM

(71) Applicant: John Ross, Massillon, OH (US)

(72) Inventor: John Ross, Massillon, OH (US)

( * ) Notice: Subject to any disclaimer, the term of this patent is extended or adjusted under 35 U.S.C. 154(b) by 0 days.

(21) Appl. No.: 17/154,087

(22) Filed: Jan. 21, 2021

(51) Int. Cl.
*H05B 47/19* (2020.01)
*H05B 47/105* (2020.01)
*G08C 17/02* (2006.01)

(52) U.S. Cl.
CPC ..... *H05B 47/19* (2020.01); *G08C 17/02* (2013.01); *H05B 47/105* (2020.01)

(58) Field of Classification Search
CPC ..... H05B 45/20; H05B 47/19; H05B 47/16; H05B 47/105; H05B 45/10; H05B 47/11; H05B 47/195; H05B 47/115; H05B 45/395; H05B 45/3725; H05B 45/375; H05B 47/125; H05B 45/00; H05B 45/325; H05B 45/38; H05B 47/12; H05B 47/165; H05B 47/10; H05B 45/12; H05B 45/357; H05B 47/175; H05B 2213/06; H05B 33/22; H05B 3/008; H05B 45/30; H05B 45/3575; H05B 45/385; H05B 45/40; H05B 45/46; H05B 45/60; H05B 47/155; H05B 47/24; H05B 47/28; H05B 6/062; H05B 6/065; H05B 6/1209; H05B 6/6441; H05B 47/18; H05B 47/185
See application file for complete search history.

(56) References Cited

U.S. PATENT DOCUMENTS

| | | | | |
|---|---|---|---|---|
| 10,111,307 | B2 | 10/2018 | Li | |
| 10,648,631 | B2 | 5/2020 | Li | |
| 2005/0007779 | A1 | 1/2005 | Nozawa | |
| 2014/0268652 | A1 | 9/2014 | Li | |
| 2016/0312969 | A1* | 10/2016 | Patton | H05B 47/115 |
| 2017/0159900 | A1* | 6/2017 | Gerson | H05B 47/19 |

* cited by examiner

*Primary Examiner* — Monica C King

(57) ABSTRACT

An electronic candle system for providing a sanitary and reusable birthday candle solution includes a plurality of electronic candles and a remote control. Each electronic candle comprises a body and a translucent cover coupled to a body top side. A light is coupled to the body top side and extends within the cover. A receiver is coupled within the body. The remote control a transceiver coupled within a remote housing. The transceiver is in operational communication with the receiver of each electronic candle of the plurality of electronic candles. A plurality of controls is coupled to the remote housing and is in operational communication with the transceiver. An air sensor is coupled to the remote housing to be blown on by a user to turn off the light of each of the plurality of electronic candles.

8 Claims, 5 Drawing Sheets

ELECTRONIC CANDLE SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to electronic candle devices and more particularly pertains to a new electronic candle device for providing a sanitary and reusable birthday candle solution. The present device includes a remote control in wireless communication with a plurality of electronic candles. The remote control can illuminate desired candles and be blown on to turn off the candles.

(2) DESCRIPTION OF RELATED ART INCLUDING INFORMATION DISCLOSED UNDER 37 CFR 1.97 AND 1.98

The prior art relates to electronic candle devices. Most existing electronic candles cannot be controlled with a remote. Of those that can, few have a sensor to be blown on to turn off the candles. These remotes and sensors cannot control individual candles.

BRIEF SUMMARY OF THE INVENTION

An embodiment of the disclosure meets the needs presented above by generally comprising a plurality of electronic candles and a remote control. Each electronic candle comprises a body having a body top side, a body bottom side, and a body sidewall defining a body inside. A cover is coupled to the body top side and is translucent. A light is coupled to the body top side and extends within the cover. A candle battery is coupled to the body within the body inside. The candle battery is in operational communication with the light. A receiver is coupled to the body. The receiver is coupled within the body inside and is in operational communication with the candle battery. The remote control comprises a remote housing having a housing front side, a housing back side, and a housing perimeter. A transceiver is coupled within the remote housing. The transceiver is in operational communication with the receiver of each electronic candle of the plurality of electronic candles. A plurality of controls is coupled to the remote housing. The plurality of controls is in operational communication with the transceiver. An air sensor is coupled to the remote housing. The air sensor is in operational communication with the transceiver and is configured to be blown on by a user to turn off the light of each of the plurality of electronic candles. A remote battery is coupled within the remote housing and is in operational communication with the transceiver.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
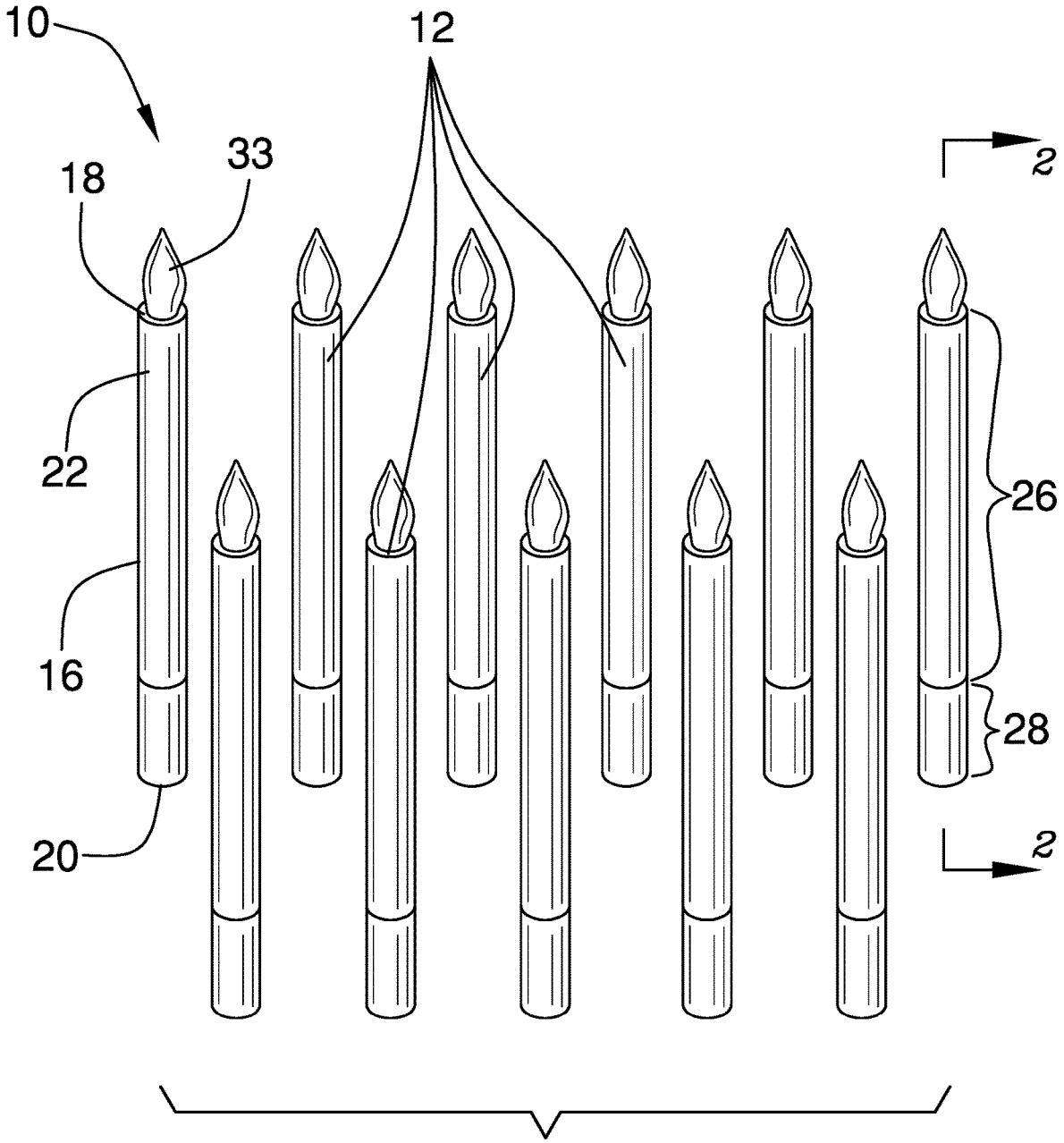
FIG. 1 is an isometric view of an electronic candle system according to an embodiment of the disclosure.
Figure 2:
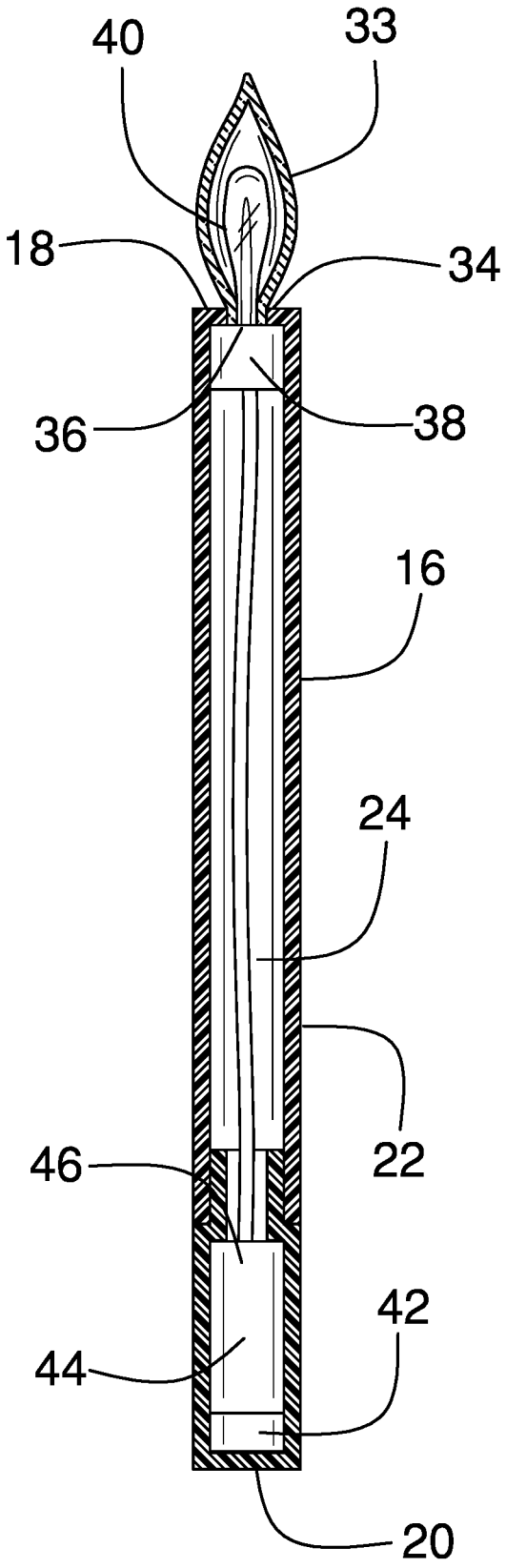
FIG. 2 is a cross-sectional view of an embodiment of the disclosure along the line 2-2 of FIG. 1.
Figure 3:
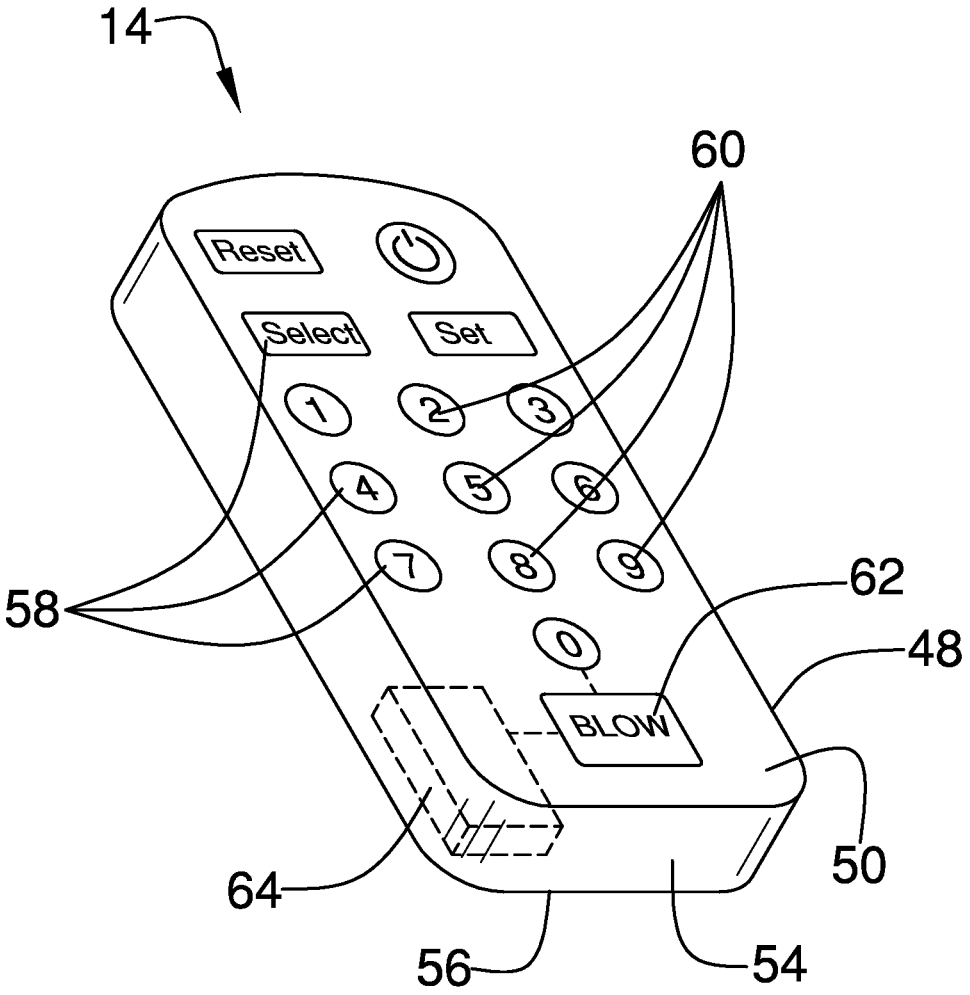
FIG. 3 is an isometric view of an embodiment of the disclosure.
Figure 4:
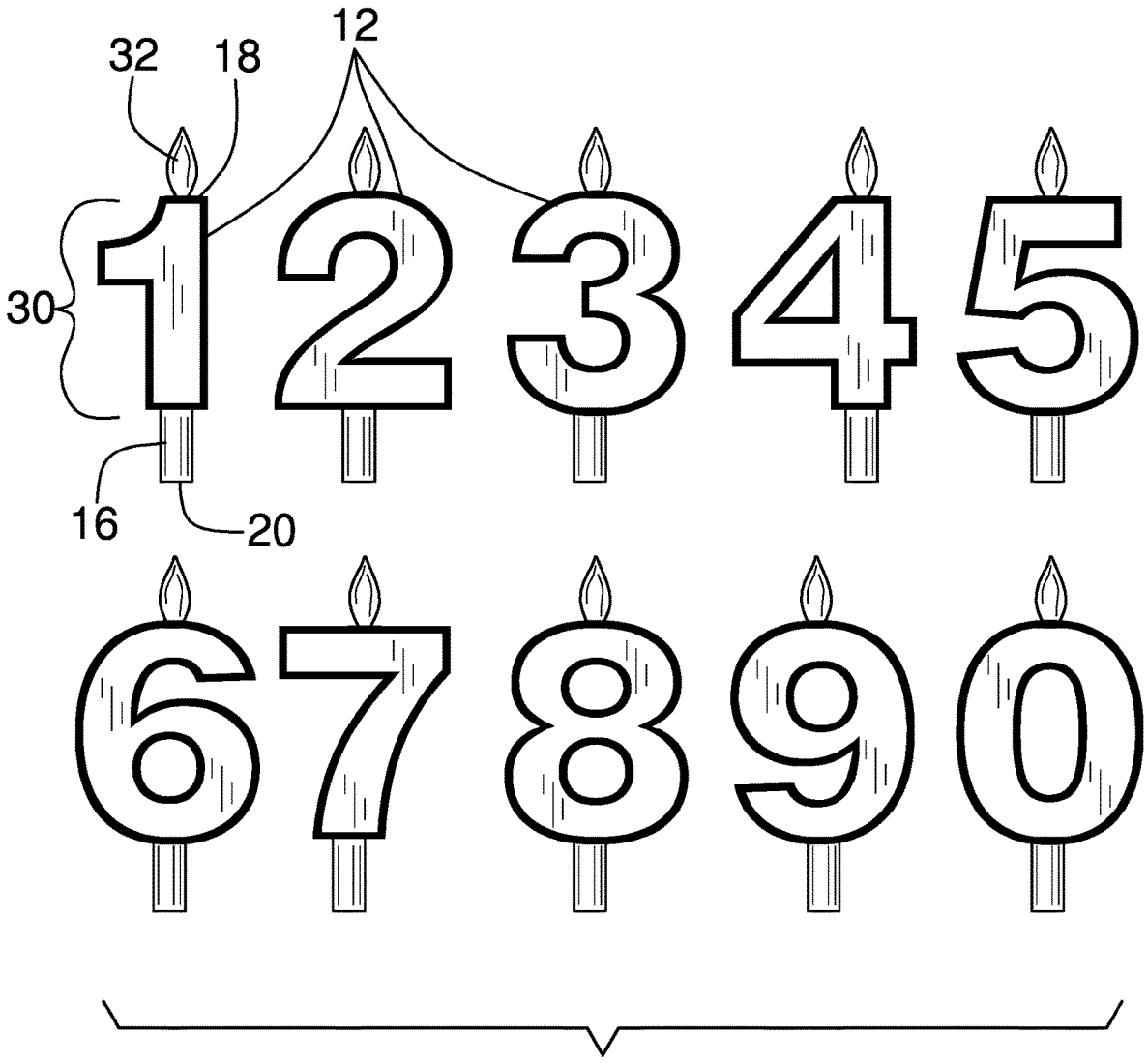
FIG. 4 is a front elevation view of an embodiment of the disclosure.

With reference now to the drawings, and in particular to FIGS. 1 through 5 thereof, a new electronic candle device embodying the principles and concepts of an embodiment of the disclosure and generally designated by the reference numeral 10 will be described.

Figure 5:
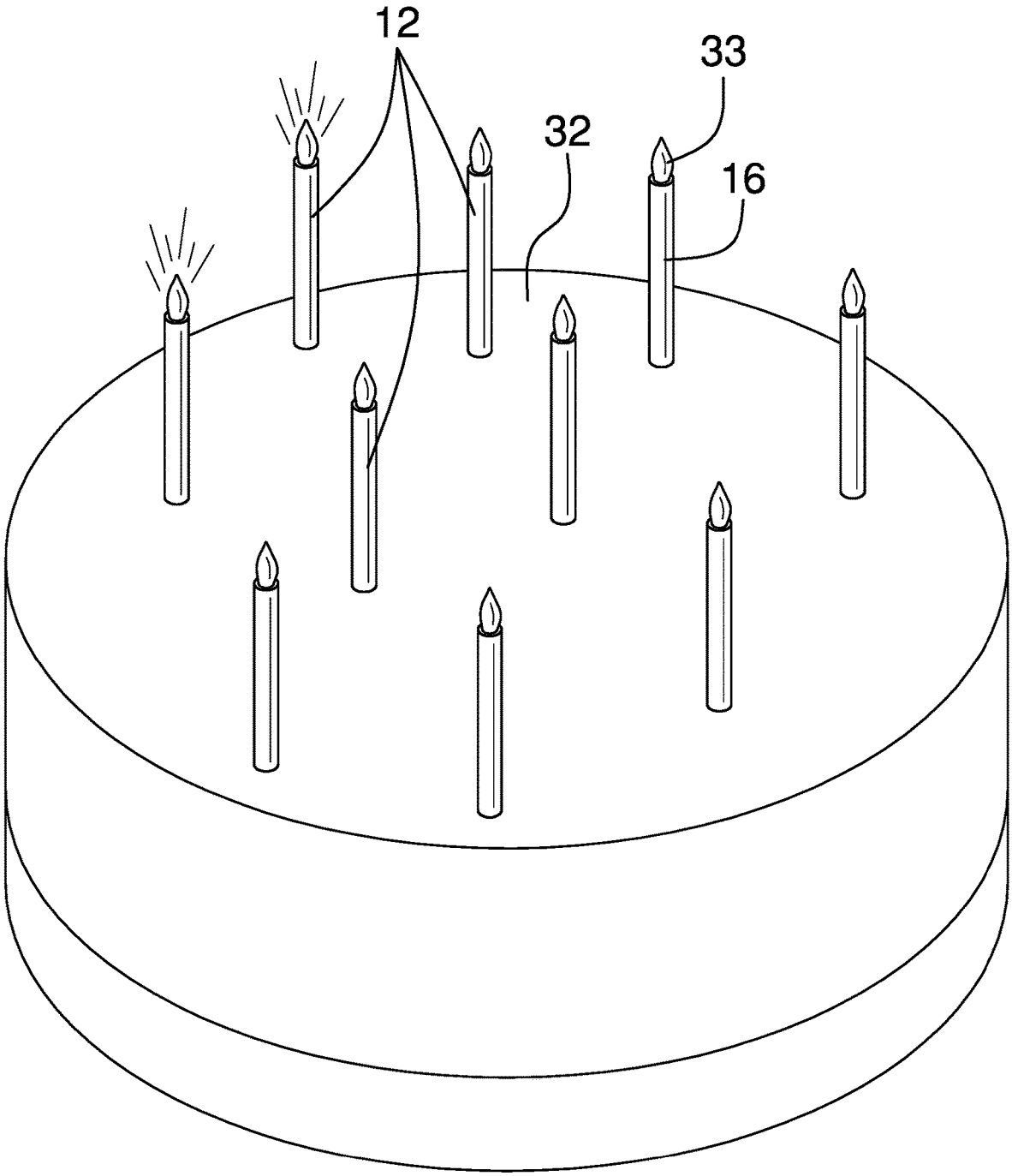
FIG. 5 is an isometric in-use view of an embodiment of the disclosure.

As best illustrated in FIGS. 1 through 5, the electronic candle system 10 generally comprises a plurality of electronic candles 12 and a remote control 14. Each electronic candle 12 comprises a body 16 having a body top side 18, a body bottom side 20, and a body sidewall 22 defining a body inside 24. The body sidewall 22 may be cylindrical (as shown in FIGS. 1 and 5) and the may include a main portion 26 and a bottom portion 28 selectively engaged with the main portion 24.

The body 16 may alternatively include a number portion 30 shaped as a digit from 0 to 9 as shown in FIG. 5. The plurality of electronic candles 12 may include a pair of each digit from 0 to 9 in order to form any number from 1 to 110.

The bottom portion 28 may extend from the number portion 30 to be inserted into a cake 32 to support the body 16 upright.

A cover 33 is coupled to the body 16. The cover 32 is coupled to the body top side 18 and may extend into a light aperture 34 extending through to the body inside 24. The cover 33 may be translucent and flame-shaped. A light 36 is coupled to the body 16. The light 36 is coupled to the body top side 18 and extends within the cover 32. The light 36 may have a light body portion 38 coupled within the body inside 24 and a bulb portion 40 within the cover 32. The bulb portion 40 may be a light emitting diode.

A candle battery 42 is coupled to the body 16. the candle battery 42 is coupled within the body inside 24 and is in operational communication with the light 36. A receiver 44 is coupled within the body inside 24 and is in operational communication with the candle battery 42. The receiver 44 and the candle battery 42 may be coupled within the bottom portion 28. The receiver 44 may have an integrated switch 46 in operational communication with the candle battery 42 that is operated by twisting the bottom portion 28 relative the main portion 26.

The remote control 14 comprises a remote housing 48 having a housing front side 50, a housing back side 52, and a housing perimeter 54. A transceiver 56 is coupled within the remote housing 48. The transceiver is in operational communication with the receiver 44 of each electronic candle of the plurality of electronic candles 12.

A plurality of controls 58 is coupled to the remote housing 48 and is in operational communication with the transceiver 56. The plurality of controls 58 may be coupled to the housing front side 50. The plurality of controls 58 includes a plurality of number buttons 60 to control each electronic candle 12 having the corresponding number portion 30.

An air sensor 62 is coupled to the remote housing 48. The air sensor 62 may be coupled to the housing front side 50 proximal the housing perimeter 54. The air sensor 62 is in operational communication with the transceiver 56 and is configured to be blown on by a user to turn off the light 36 of each of the plurality of electronic candles. The air sensor 62 may detect the strength of air blown there on to in order to turn off a proportionate number of the plurality of electronic candles 12 and cause some of the plurality of electronic candles 12 to flicker. When blown on a second time, the air sensor 62 will turn off the remainder of the electronic candles 12. A remote battery 64 is coupled within the remote housing 48 and is in operational communication with the transceiver 56.

In use, the desired number of electronic candles 12 or the electronic candles 12 with the appropriate number portion 30 are placed onto a cake 32. The plurality of controls 58 are then used to turn on the light 36 of these electronic candles 12. The user then blows on the air sensor 62 until all of the lights 36 of the electronic candles have been turned off.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An electronic candle system comprising:

a plurality of electronic candles, each electronic candle comprising:

a body having a body top side, a body bottom side, and a body sidewall defining a body inside;

a cover coupled to the body, the cover being coupled to the body top side, the cover being translucent;

a light coupled to the body, the light being coupled to the body top side and extending within the cover;

a candle battery coupled to the body, the candle battery being coupled within the body inside, the candle battery being in operational communication with the light; and a receiver coupled to the body, the receiver being coupled within the body inside, the receiver being in operational communication with the candle battery; and a remote control comprising:

a remote housing having a housing front side, a housing back side, and a housing perimeter;

a transceiver coupled within the remote housing, the transceiver being in operational communication with the receiver of each electronic candle of the plurality of electronic candles;

a plurality of controls coupled to the remote housing, the plurality of controls being in operational communication with the transceiver;

an air sensor coupled to the remote housing, the air sensor being in operational communication with the transceiver and being configured to be blown on by a user to turn off the light of each of the plurality of electronic candles; and a remote battery coupled within the remote housing, the remote battery being in operational communication with the transceiver.

2. The electronic candle system of claim 1 further comprising the cover being flame-shaped.

3. The electronic candle system of claim 1 further comprising the body being cylindrical and including a main portion and a bottom portion selectively engaged with the main portion, the receiver and the candle battery being coupled within the bottom portion.

4. The electronic candle system of claim 1 further comprising the body sidewall having a number portion shaped as a digit from 0 to 9, the plurality of electronic candles including a pair of each digit from 0 to 9.

5. The electronic candle system of claim 4 further comprising the plurality of controls including a plurality of number buttons to control each electronic candle having the corresponding number portion.

6. The electronic candle system of claim 1 further comprising the air sensor detecting the strength of air blown there on to and turning off a proportionate number of the plurality of electronic candles.

7. The electronic candle system of claim 6 further comprising the air sensor detecting the strength of air blown there on to and causing some of the plurality of electronic candles to flicker.

8. An electronic candle system comprising:

a plurality of electronic candles, each electronic candle comprising:

a body having a body top side, a body bottom side, and a body sidewall defining a body inside, the body sidewall having a number portion shaped as a digit from 0 to 9, the plurality of electronic candles including a pair of each digit from 0 to 9;

a cover coupled to the body, the cover being coupled to the body top side, the cover being translucent and flame-shaped;

a light coupled to the body, the light being coupled to the body top side and extending within the cover;

a candle battery coupled to the body, the candle battery being coupled within the body inside, the candle battery being in operational communication with the light; and a receiver coupled to the body, the receiver being coupled within the body inside, the receiver being in operational communication with the candle battery; and a remote control comprising:

a remote housing having a housing front side, a housing back side, and a housing perimeter;

a transceiver coupled within the remote housing, the transceiver being in operational communication with the receiver of each electronic candle of the plurality of electronic candles;

a plurality of controls coupled to the remote housing, the plurality of controls being in operational communication with the transceiver, the plurality of controls including a plurality of number buttons to control each electronic candle having the corresponding number portion;

an air sensor coupled to the remote housing, the air sensor being in operational communication with the transceiver and being configured to be blown on by a user to turn off the light of each of the plurality of electronic candles, the air sensor detecting the strength of air blown there on to and turning off a proportionate number of the plurality of electronic candles and causing some of the plurality of electronic candles to flicker; and a remote battery coupled within the remote housing, the remote battery being in operational communication with the transceiver.

* * * * *